US005561503A

United States Patent [19]

Masuda

[11] Patent Number: 5,561,503

[45] Date of Patent: Oct. 1, 1996

[54] SERIAL-TYPE ELECTRONIC PHOTOGRAPHIC PRINTER WITH IMPROVED IMAGE QUALITY

[75] Inventor: Syuzo Masuda, Kawasaki, Japan

[73] Assignee: Fujitsu Limited, Kawasaki, Japan

[21] Appl. No.: 426,694

[22] Filed: Apr. 24, 1995

[30] Foreign Application Priority Data

May 18, 1994 [JP] Japan ..... 6-104087

[51] Int. Cl.[6] ..... G03G 15/22

[52] U.S. Cl. ..... 355/210; 355/211

[58] Field of Search ..... 355/210, 208, 355/211; 400/118.2, 118.3; 347/139, 152, 153, 133

[56] References Cited

FOREIGN PATENT DOCUMENTS 56-77167 6/1981 Japan .
61-152463 7/1986 Japan .
61-145649 9/1986 Japan .
416890 1/1992 Japan .
4128781 4/1992 Japan .

*Primary Examiner*—Joan H. Pendegrass
*Assistant Examiner*—Quana Grainger
*Attorney, Agent, or Firm*—Armstrong, Westerman, Hattori, McLeland & Naughton

[57] ABSTRACT

An image forming device includes a conveying unit for conveying a recording sheet in a first direction, a process unit for forming a latent image of static charge and developing said latent image into an image on an image-holding body, which rolls on said recording sheet in a second direction perpendicular to said first direction so as to transfer said image on to said recording sheet, an image-fixing unit for fixing said image on said recording sheet, a carriage carrying said process unit and said image-fixing unit, which carriage moves in said second direction, and a recording-sheet fixing unit for holding said recording sheet when said process unit and said image-fixing unit operate as said carriage moves.

11 Claims, 10 Drawing Sheets

SERIAL-TYPE ELECTRONIC PHOTOGRAPHIC PRINTER WITH IMPROVED IMAGE QUALITY

BACKGROUND OF THE INVENTION

1. Field of the Invention

The present invention generally relates to image forming devices, and particularly relates to an image forming device which prints out information on a recording sheet by making a latent image on a recording drum.

In recent years, electronic photographic printers of a serial type have been developed, which type carries an electronic photographic process unit on a carriage for printing information. This development was made in order to meet a demand for miniaturization and lower pricing of electronic photographic recording devices. These printers of the serial-type duplicate an image on to a recording sheet with an aid of an image-transfer unit by running the carriage in a direction perpendicular to a direction in which the recording sheet is led. The image transferred on to the recording sheet is then fixed by an image-fixing unit having a shape of a roller. However, a recent development of such printers still needs further refinement and improvement in printing qualities.

2. Description of the Prior Art

FIGS. 1A and 1B show a plan view of part of a serial-type electronic photographic printer of the prior art and a cross-sectional view of a carriage of FIG. 1A, respectively.

In FIGS. 1A and 1B, a serial-type electronic photographic printer 11 disclosed in Japanese Laid-Open Patent Application No.61-152463 includes conveying rollers 13*a* and 13*b*, which convey a recording sheet 12. The serial-type electronic photographic printer 11 also includes a shaft 14 parallel to axes of the conveying rollers 13*a* and 13*b*, and a carriage 15, which is movable in a direction along the width of the recording sheet 12 (perpendicular to the direction in which the recording sheet 12 is conveyed). The movement of the carriage 15 is guided by the shaft 14 and driven by a motor (not shown). The serial-type electronic photographic printer 11 also includes an image-fixing unit 16 fixed in a predetermined position, which has a width wider than that of the recording sheet 12. There is an image-transfer unit 17 provided beneath the recording sheet 12, as shown in FIG. 1B.

The carriage 15 includes an image-holding body 21, an electrification unit 22, a light-exposure unit (an LED array and a lens) 23, a developing unit 24, toner 25, and a developing roller 26. The image-holding body 21 rotates at a speed corresponding to the movement of the carriage 15. A surface of the image-holding body 21 is electrified by the electrification unit 22, and the light-exposure unit 23 forms a latent image of static charge on that surface. The latent image of static charge is turned into a visible toner image by the developing roller 26 of the developing unit 24 attaching the toner 25 on the above-mentioned surface. The toner image on the surface of the image-holding body 21 is transferred on to the recording sheet 12 by the image-transfer unit 17 opposing the image-holding body 21 through the recording sheet 12. The image transferred on to the recording sheet 12 is fixed by the image-fixing unit 16.

FIG. 2 shows another example of a serial-type electronic photographic printer of the prior art. The figure shows an inside structure of the carriage 15, which is disclosed in the Japanese Utility Model Laid-Open Application No.61-145649. The carriage 15 is provided with an image-fixing unit 27 in the inside thereof. The carriage 15 includes a cleaner 30, which is used for rubbing off remaining toner from the image-holding body 21 after finishing printing.

The image-fixing unit 27 is provided with an image-fixing lamp 28, and rotates in the same direction as does the image-holding body. Inside the image-fixing roller 28, a heat source 29 such as a halogen lamp is provided as heating means. The image-fixing roller 28 is heated by the heat source 29 up to a predetermined temperature prior to a printing operation. The temperature of the image-fixing unit 28 is monitored by a temperature detecting unit such as a thermistor, and is controlled during the printing operation. The image-fixing unit 27 is moved along with the image-holding body 21, and fixes an image right after the image is transferred.

Here, the transfer of the image by the image-transfer unit 17 is carried out by applying a predetermined voltage level between the image-holding body 21 and the image-transfer unit 17. Thus, the image-transfer unit 17 is formed from a plate such as a conductive rubber plate.

Although not shown in the figures, there is another type of a serial-type electronic photographic printer, in which an image-holding body (photosensitive drum) can be retracted from a surface of the recording sheet during a time of conveying the recording sheet. The retraction of the image-holding body is carried out by using a guide rod of the carriage as a fulcrum. The carriage also includes an image-fixing unit having a heat source, which illuminates light upon the recording sheet to effect a flash fixing of an image. An example of such a heat source is a halogen lamp and a xenon lamp for emitting an infrared ray. This serial-type electronic photographic printer is disclosed in the Japanese Patent Laid-Open Application No.56-77167.

The serial-type electronic photographic printer shown in FIG. 1 has a couple of problems associated with its design. In this printer, the recording sheet 12 is not conveyed continuously, but the movement of the recording sheet 12 is sporadic. Thus, a time length for which the image-fixing roller touches the recording sheet varies widely from portion to portion of the recording sheet bearing a toner image. That is, when the recording sheet stays still, a portion thereof touching the fixing roller ends up being in contact with the fixing roller for a long period. On the other hand, when the recording sheet is moved, a portion passing under the fixing roller does not have as long a contact with the fixing roller. This results in a variation in a degree of the fixing of the image, leading to a degraded image quality. Also, the contact of the image-holding body 21 with the recording sheet 12 lifts the recording sheet 12, creating a paper jam at the beginning and at the end of the recording sheet.

The serial-type electronic photographic printer shown in FIG. 2 also has a problem. In this printer, the image-holding body 21 and the fixing roller 28 are always in contact with either the image-transfer unit 17 or the recording sheet 12. Generally, the image-fixing roller 28 has a width of 30 mm, and is urged with pressure ranging from 1 kg to 2 kg. The recording sheet 12 on which the pressure is locally applied tends to be lifted from the image-transfer unit 17. The recording sheet 12 is also lifted by the image-holding body 21. These two forces to lift up the recording sheet 12 create a culminating effect which causes mismatch between a rotation rate of the image-holding body 21 and the speed of the movement of the image-holding body 21 on the recording sheet 12.

FIG. 3 shows this culminating effect observed in the serial-type printer of the prior art. As shown in FIG. 3, pressure by the image-holding body 21 and the image-fixing roller 28 lifts the recording sheet 12, resulting in the mismatch between the rotation rate and the speed of the movement. This results in the lifting of the recording sheet between the image-holding body 21 and the image-fixing roller 28, leading to a degraded image quality and jamming of sheets.

Also, when the image-fixing unit employs a heat source fixing an image by light illumination, sufficient heat cannot be applied to the recording sheet. This also creates a problem that the fixing of the image is not sufficient.

When an infrared lamp is used, an infrared ray emitted by the lamp has too low an energy density to fix an image within a short time. Also, when the recording sheet is jammed, there is a high probability of the recording sheet catching on fire. When a xenon lamp is used for a flash fix, a condenser of a large capacity become necessary. Also, the flash fix causes problems of flying toner and annoying noise. Furthermore, it is difficult to have a continuous illumination of light for the serial-type printer. Both the infrared lamp and the xenon lamp are bound to be placed near the photosensitive drum, so that the sealing of the drum from the light exposure is difficult to attain. Also, since only the image-holding body touches the recording sheet without the image-fixing unit touching it, the recording sheet may be lifted up to cause deficiencies in a printing quality.

Accordingly, there is a need in the field of serial-type electronic photographic printers for a serial-type electronic photographic printer which can prevent the lifting of a recording sheet and improve the printing quality.

SUMMARY OF THE INVENTION

Accordingly, it is a general object of the present invention to provide a serial-type electronic photographic printer which can satisfy the need described above.

It is another and more specific object of the present invention to provide serial-type electronic photographic printers for a serial-type electronic photographic printer which can prevent the lifting of a recording sheet and improve the printing quality.

In order to achieve the above objects according to the present invention, an image forming device includes a conveying unit for conveying a recording sheet in a first direction, a process unit for forming a latent image of static charge and developing the latent image into an image on an image-holding body, which rolls on the recording sheet in a second direction perpendicular to the first direction so as to transfer the image on to the recording sheet, an image-fixing unit for fixing the image on the recording sheet, a carriage carrying the process unit and the image-fixing unit, which carriage moves in the second direction, and a recording-sheet fixing unit for holding the recording sheet when the process unit and the image-fixing unit operate as the carriage moves.

In the image forming device described above, the recording-sheet fixing unit holds the recording sheet only during the operations of the process unit and the image-fixing unit. Thus, the lifting of the recording sheet can be avoided during these operations, which results in the improved printing quality.

The above objects can also be achieved by an image forming device including a conveying unit for conveying a recording sheet in a first direction, a process unit for forming a latent image of static charge and developing the latent image into an image on an image-holding body, which rolls on the recording sheet in a second direction perpendicular to the first direction so as to transfer the image on to the recording sheet, an image-fixing unit for fixing the image on the recording sheet by touching the recording sheet, a carriage carrying the process unit and the image-fixing unit, which carriage moves in the second direction, a first retraction unit for separating the process unit from the recording sheet when the image-fixing unit is operating, and a second retraction unit for separating the image-fixing unit from the recording sheet when the process unit is operating.

According to the image forming device described above, the first and second retraction units can retract the process unit and the image-fixing unit, respectively. Thus, the image-fixing unit does not affect the operation of the process unit, so that the lifting of the recording sheet can be avoided. This results in an improved printing quality.

Other objects and further features of the present invention will be apparent from the following detailed description when read in conjunction with the accompanying drawings.

DESCRIPTION OF THE PREFERRED EMBODIMENTS

Figure 1A:
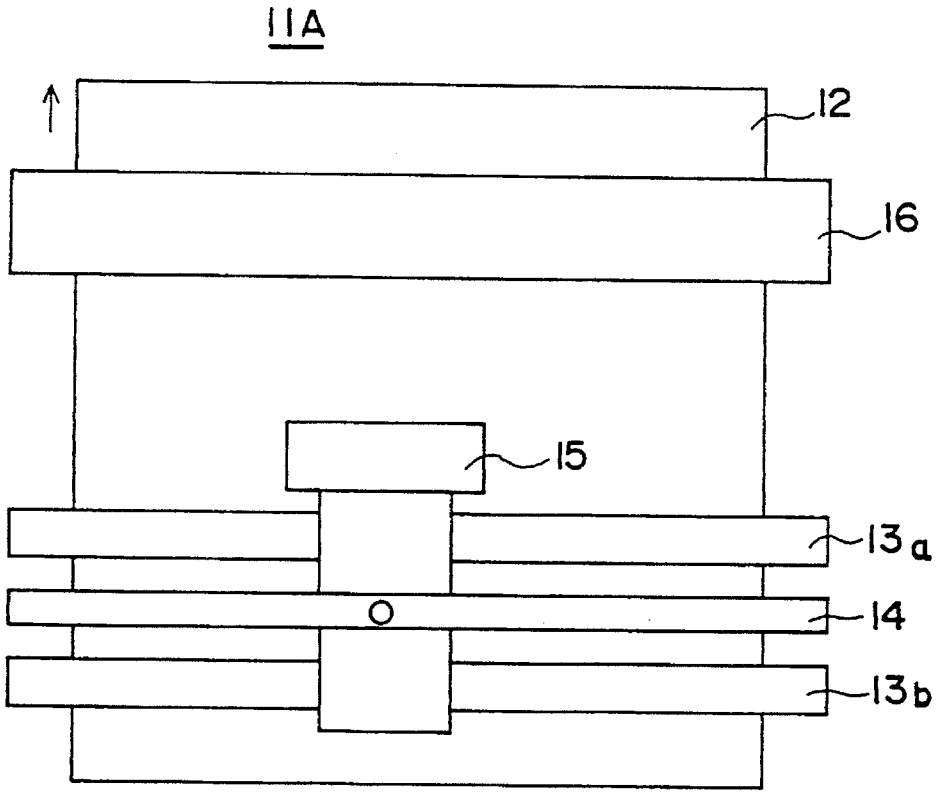
FIG. 1A PRIOR ART
FIGS. 1A and 1B are a plan view and a cross-sectional view, respectively, of a serial-type electronic photographic printer of the prior art.
Figure 1B:
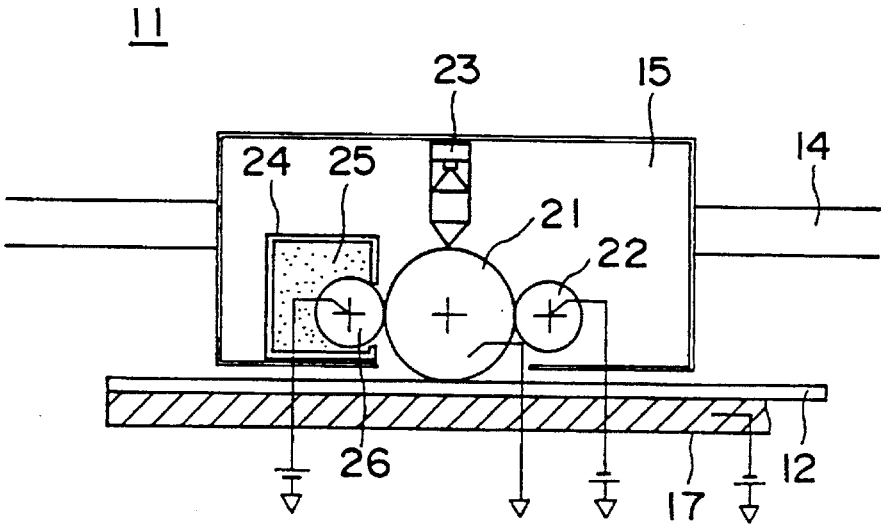
FIG. 1B PRIOR ART
Figure 2:
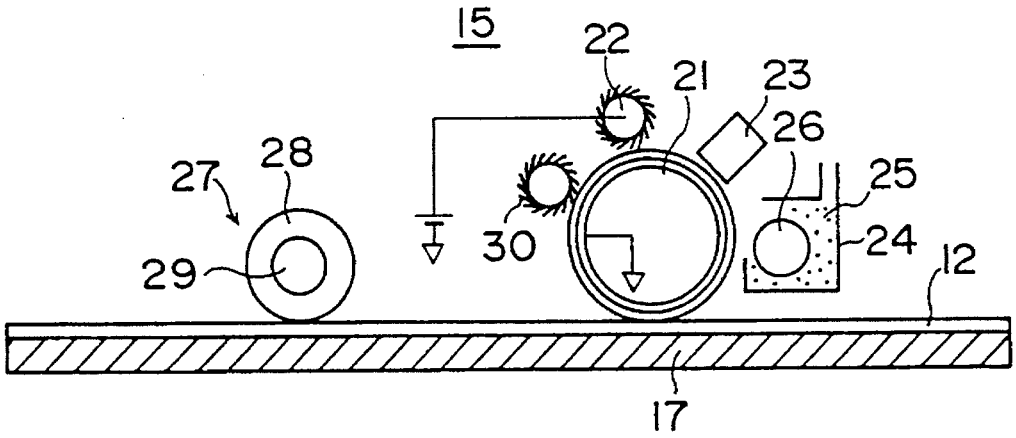
FIG. 2 PRIOR ART
FIG. 2 is a diagram showing another example of a serial-type electronic photographic printer of the prior art.
Figure 3:
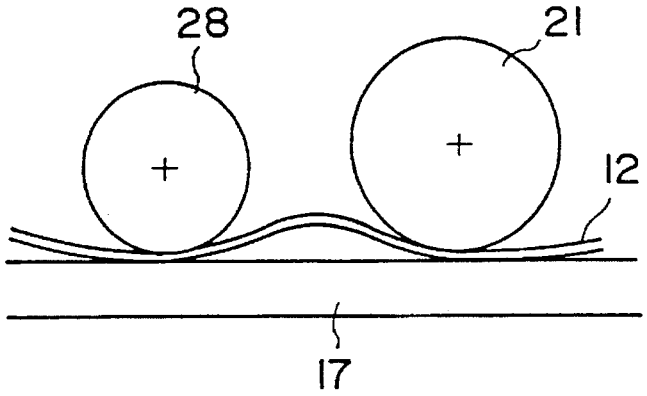
FIG. 3 PRIOR ART
FIG. 3 is an illustrative drawing showing a problem of the serial-type electronic photographic printer of FIG. 2.
Figure 4:
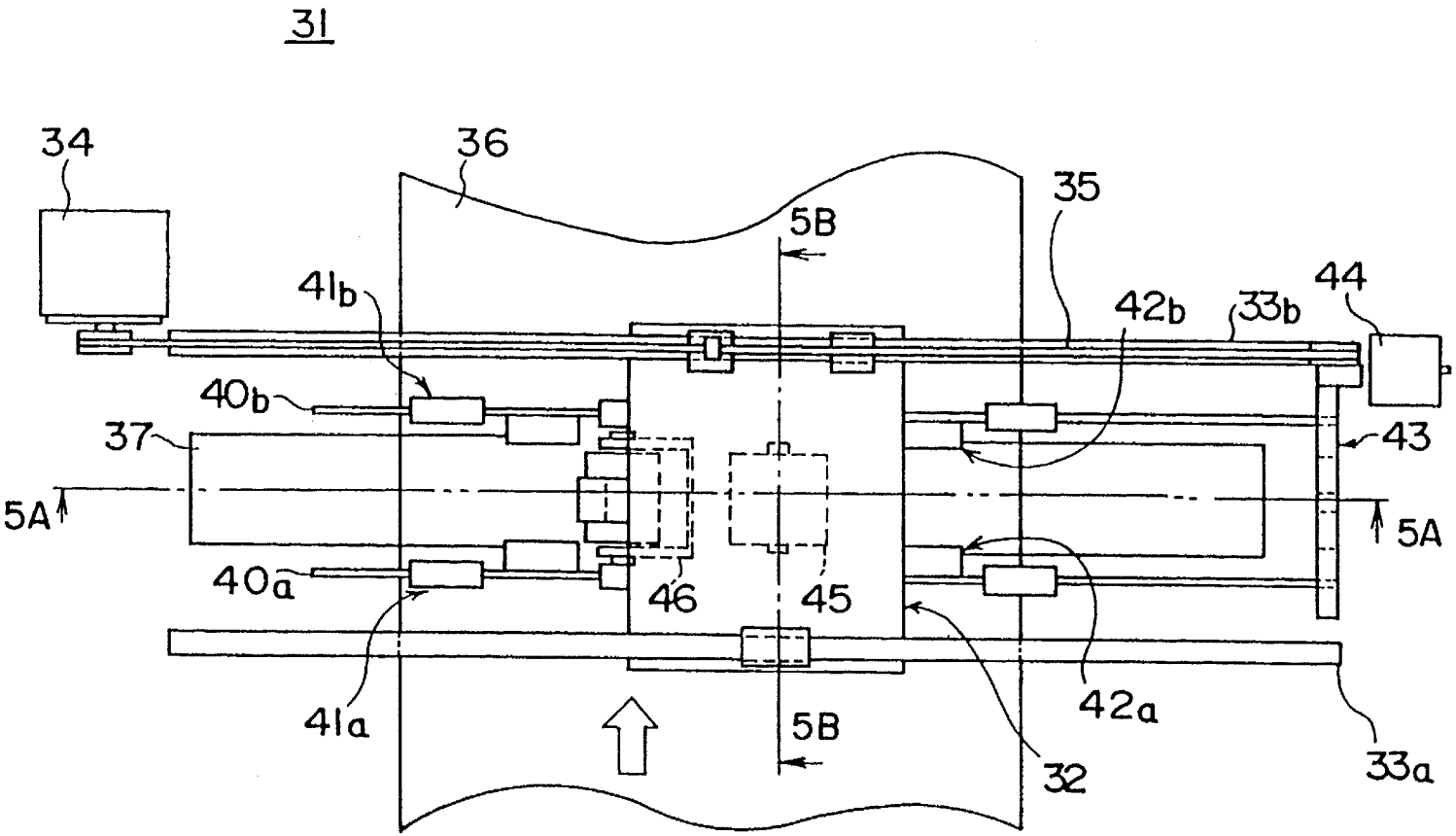
FIG. 4 is a plane view of a serial-type electronic photographic printer according to a first embodiment of the present invention.

FIG. 4 shows a plan view of part of a serial-type electronic photographic printer according to a first embodiment of the present invention.

A serial-type electronic photographic printer 31 includes a carriage 32 having a process unit 45 as process means and a image-fixing unit 46 as image-fixing means. The serial-type electronic photographic printer 31 also includes guide shafts 33*a* and 33*b*, a carrier motor 34 as movement means, and a belt 35. The carriage 32 is guided by the guide shafts 33*a* and 33*b*, and is moved by the carrier motor 34 through the belt 35 in a direction perpendicular to a direction of conveying a recording sheet 36.

The serial-type electronic photographic printer 31 also includes an image-transfer unit 37, conveying rollers 38*a* and 38*b* (shown in FIG. 5B), conveying shafts 39*a* and 39*b* (shown in FIG. 5B), swinging shafts 40*a* and 40*b*, rollers 41*a* and 41*b*, clampers 42*a* and 42*b*, a gear mechanism 43, and a clamp motor 44.

The image-transfer unit 37 is provided under the carriage 32 and between the guide shafts 33*a* and 33*b*, and extends in a direction of the movement of the carriage 32. On both sides of the image-transfer unit 37, the conveying shafts 39*a* and 39*b* are provided as conveying means (not shown in FIG. 4, shown in FIG. 5B) extending in the direction of the movement of the carriage 32. The conveying rollers 38*a* and 38*b* are provided on the conveying shafts 39*a* and 39*b*, respectively, to convey the recording sheet 36 in a direction shown by an arrow.

The swinging shafts 40*a* and 40*b*, are positioned over the conveying shafts 39*a* and 39*b*, and have the rollers 41*a* and 41*b*, respectively. The rollers 41*a* and 41*b* are free to rotate. A predetermined number of the clampers 42*a* and 42*b* are provided for the swinging shafts 40*a* and 40*b*, respectively.

The swinging shafts 40*a* and 40*b* are rotated by the clamp motor 44, which is clamper driving means, through the gear mechanism 43. This swinging operation will be described later. The clampers 42*a* and 42*b* and the clamp motor 44 form recording-sheet fixing means.

The image-transfer unit 37 is a plate formed from aluminum and the like, whose surface on a side facing the carriage has a refractory conductive member such as silicon rubber mixed with a conductive material.

Figure 5A:
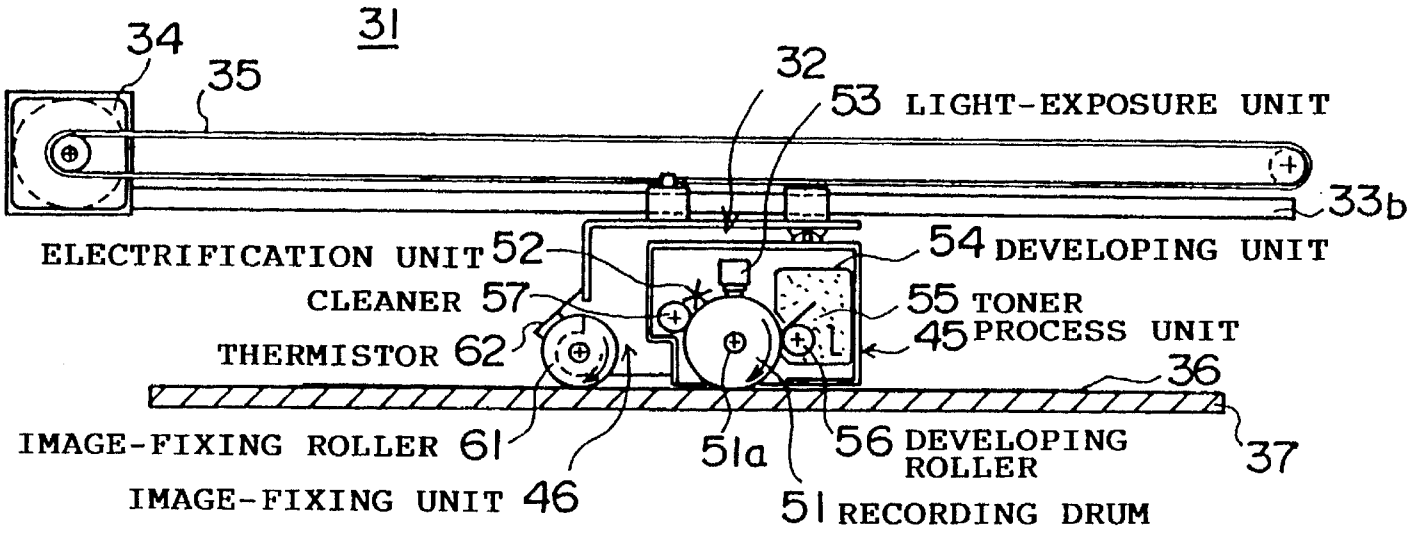
FIGS. 5A and 5B are, respectively, a cross-sectional view taken along a line A—A of FIG. 4 and a cross-sectional view of an image-fixing unit of FIG. 5A.
Figure 5B:
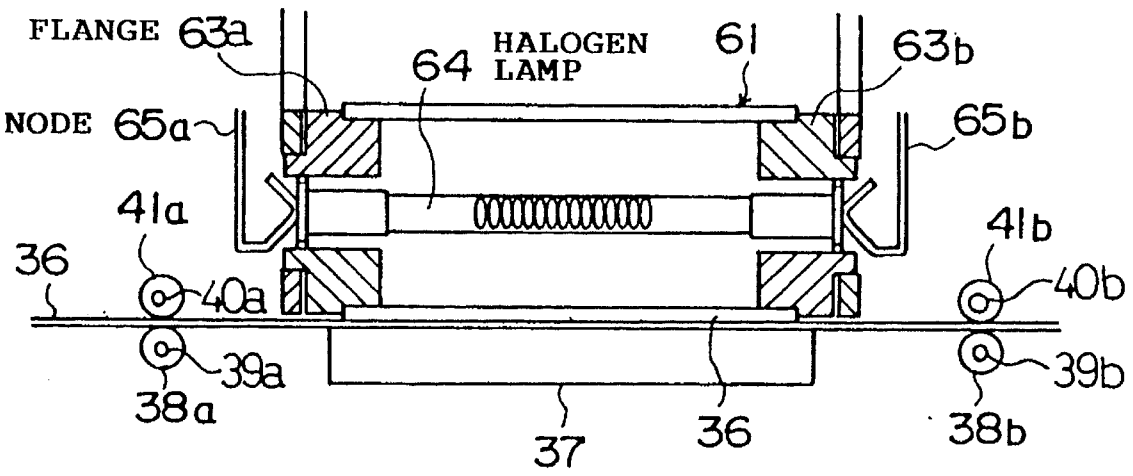

FIGS. 5A and 5B show cross-sectional views taken along a line A—A and a line B—B, respectively.

In FIG. 5A, the carriage 32 is comprised of the process unit 45 and the image-fixing unit 46. The process unit 45 is provided with a recording drum 51, which serves as the image-holding body and has a rotation axis 51*a* parallel to the direction of conveying the recording sheet 36. The recording drum 51 rolls on the recording sheet 36 over the image-transfer unit 37 at a rotation rate corresponding to the movement of the carriage 32.

A surface of the recording drum 51 is uniformly electrified by an electrification unit 52, and a latent image of static charge is formed on the surface by a light-exposure unit 53. The latent image of static charge is turned into a visible toner image by a developing roller 56 of a developing unit 54 attaching the toner 55 on to the above-mentioned surface. The toner image on the surface of the recording drum 51 is transferred on to the recording sheet 36 by applying a predetermined voltage level between the image-transfer unit 37 and the recording drum 51. Here, the developing roller 56 is rotated at a rotation rate of a predetermined ratio (e.g. from 1.1 to 2.0) to the rotation rate of the recording drum 51.

After the transfer of the image, the recording drum 51 is discharged, and, then, remaining toner on the recording drum 51 is rubbed off by a cleaner 57.

The image-fixing unit 46 is provided with an image-fixing roller 61 and with a thermistor 62 for detecting temperature of the image-fixing roller 61 in order to control the temperature.

In FIG. 5B, the image-fixing roller 61 of the image-fixing unit 46 has flanges 63*a* and 63*b* on both ends thereof. A halogen lamp 64 is provided as heating means between centers of the flanges 63*a* and 63*b*. Nodes 65*a* and 65*b* across which a voltage level is applied are in contact with both ends of the halogen lamp 64.

Figure 6A:
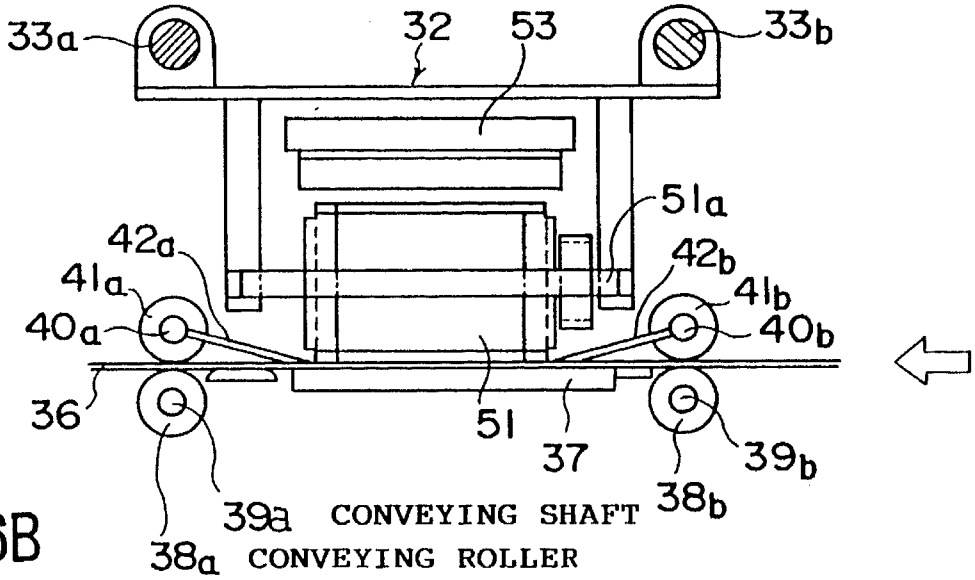
FIGS. 6A and 6B are, respectively, a cross-sectional view taken along a line B—B of FIG. 4 and a plan view of recording-sheet fixing means of the first embodiment.
Figure 6B:
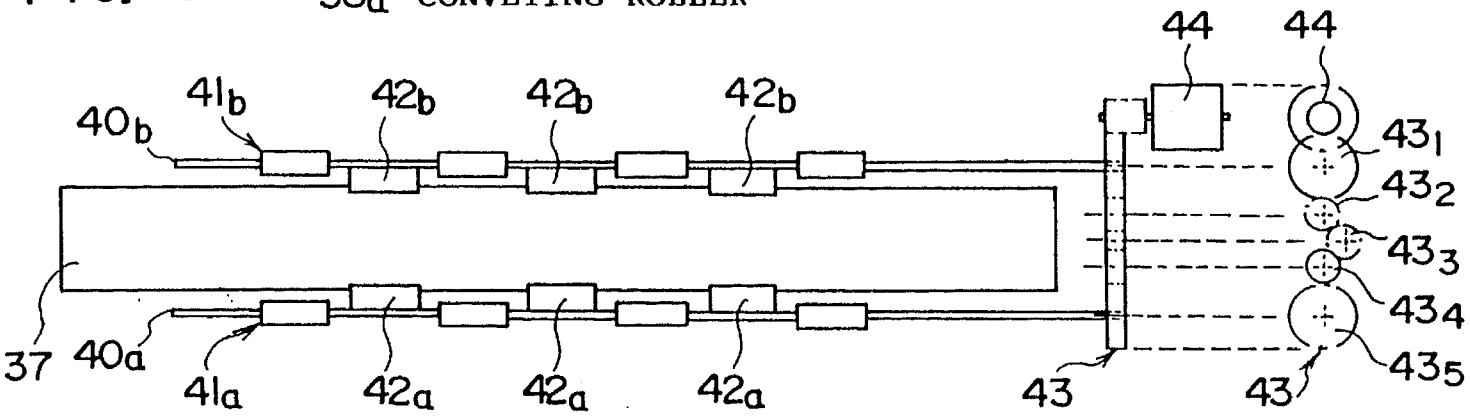

FIGS. 6A and 6B show a cross-sectional view taken along a line B—B of FIG. 4 and a plan view of the recording-sheet fixing means, respectively.

In FIG. 6A, the recording sheet 36 is conveyed by the conveying rollers 38*a* and 38*b* between the recording drum 51 and the image-transfer unit 37. The swinging shafts 40*a* and 40*b* are rotated so that the clampers 42*a* and 42*b* push down the recording sheet 36. The recording drum 51 and the image-fixing roller 61 are rotated to roll on the recording sheet 36 over the image-transfer unit 37.

In FIG. 6B, the swinging shafts 40*a* and 40*b* provided with the clampers 42*a* and 42*b* are fixed to rotation axes of a gear $\mathbf{43}_1$ and a gear $\mathbf{43}_5$, respectively, of the gear mechanism 43. The gear mechanism 43 is used for conveying the rotation of the clamp motor 44 to the gears $\mathbf{43}_1$ through $\mathbf{43}_5$. Here, the rotation of the gear $\mathbf{43}_1$ is of a reverse direction to the rotation of the gear $\mathbf{43}_5$. That is, the rotation of the clamp motor 44 brings about the rotations of the swinging shafts 40*a* and 40*b* which make the clampers 42*a* and 42*b* push against the recording sheet 36. A reverse rotation of the clamp motor 44 brings about the rotations of the swinging shafts 40*a* and 40*b* such that the clampers 42*a* and 42*b* are separated from the recording sheet 36.

Figure 7A:
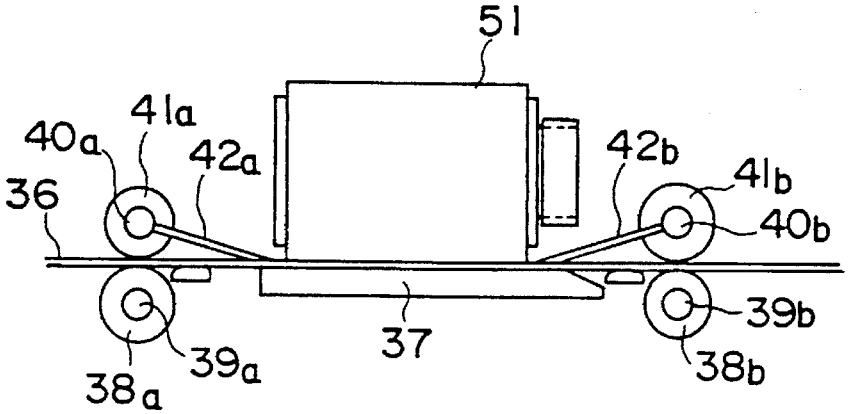
FIGS. 7A through 7E are illustrative drawings for explaining an operation of the recording-sheet fixing means of FIG. 6B.

FIGS. 7A through 7E show an operation of the recording-sheet fixing means. FIG. 7A shows a state in which the recording sheet 36 on the image-transfer unit 37 is pushed down by the clampers 42*a* and 42*b*, which are swung by the rotation of the swinging shafts 40*a* and 40*b*, respectively. In this state, the recording drum 51 prints on the recording sheet 36.

Figure 7B:
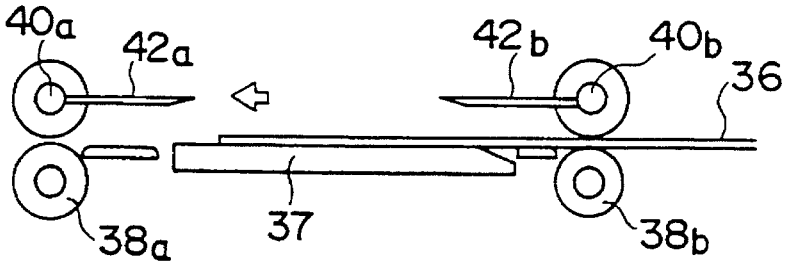
Figure 7C:
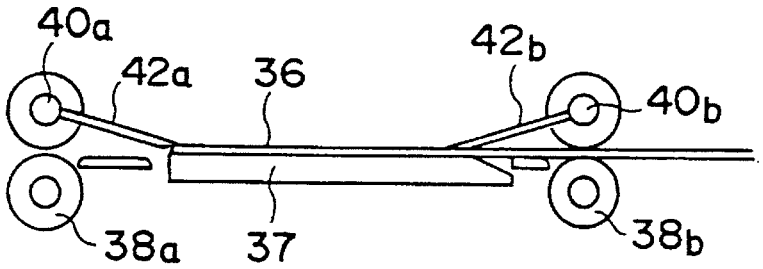

FIG. 7B shows a state in which the recording sheet 36 is being conveyed. In this state, the clampers 42*a* and 42*b* are lifted up by the rotations of the swinging shafts 40*a* and 40*b*, respectively. FIG. 7C shows a state in which the recording sheet 36 is conveyed to a predetermined print-start position. In this state, the clampers 42*a* and 42*b* are pushed against the recording sheet 36 by the rotation of the swinging shafts 40*a* and 40*b*, respectively. From this position, the recording drum 51 starts printing, while the image-fixing roller fixes an image printed on the recording sheet 36. When one line has been printed, the clampers 42*a* and 42*b* are separated from the recording sheet 36, and, then, the recording sheet 36 is moved by a width of one line. Then, the clampers 42*a* and 42*b* are pushed down again in order to start printing again.

Figure 7D:
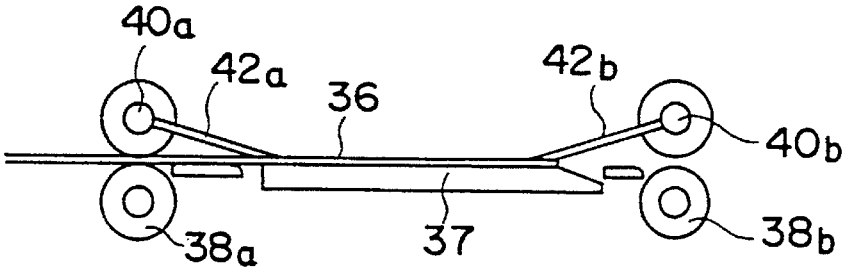
Figure 7E:
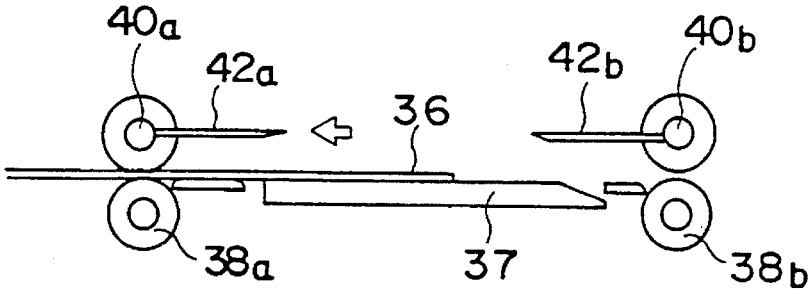

FIG. 7D shows a state in which the final line on the recording sheet 36 is being printed. FIG. 7E shows a state in which the clampers 42*a* and 42*b* are separated from the recording sheet 36 by the rotation of the swinging shafts 40*a* and 40*b*, and the recording sheet 36 is being fed out from the printer.

In this manner, when the recording drum 51 and the fixing roller 61 are, respectively, printing and fixing an image, the clampers 42*a* and 42*b* are pushed down to hold the recording sheet 36. Because of this, the lifting of the recording sheet 36 can be prevented from happening, and, thus, the jamming of the recording sheet can be avoided. This leads to an improved printing quality, which printing is free from displacements of image segments and coloring of a background.

Figure 8:
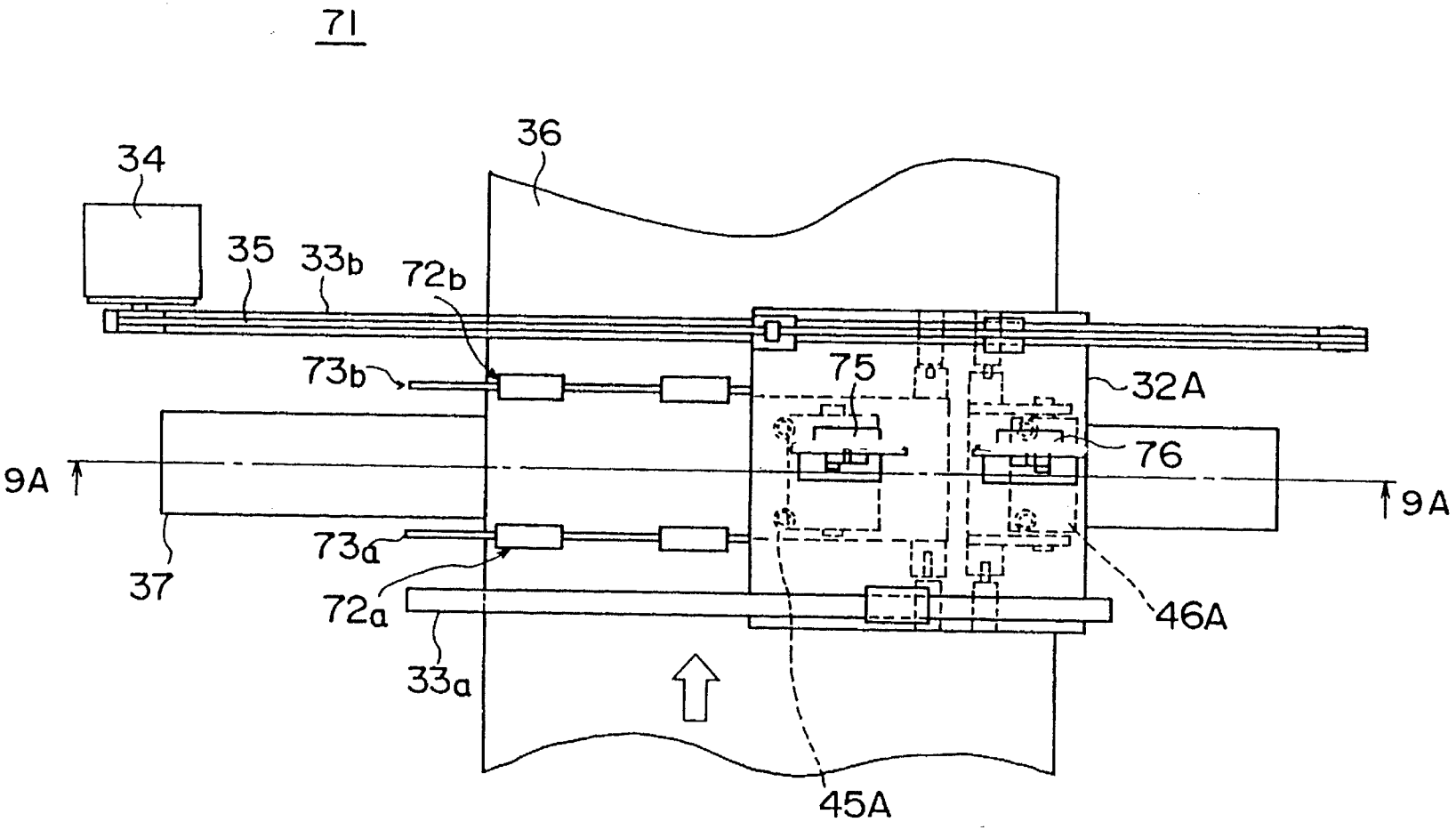
FIG. 8 is a plan view of a serial-type electronic photographic printer according to a second embodiment of the present invention.

FIG. 8 shows a second embodiment of the present invention. The same elements of FIG. 8 as those of FIG. 4 are referred to by the same numerals, and a description thereof will be omitted. A serial-type electronic photographic printer 71 includes holding shafts 73*a* and 73*b* and rollers 72*a* and 72*b* provided for the holding shafts 73*a* and 73*b*, respectively. The rollers 72*a* and 72*b* are positioned on and in contact with the conveying rollers 38*a* and 38*b*, respectively, arranged on both sides of the image-transfer unit 37.

A carriage $32_A$ is moved by the carrier motor 34 through the belt 35 while guided by the guide shafts 33*a* and 33*b*. The carriage $32_A$ has a process unit $45_A$ and an image-fixing unit $46_A$, both of which are mounted so as to be rotatable. In this configuration, the image-fixing unit $46_A$ is provided inside the carriage $32_A$ on a side nearer a print-end position.

Figures 9A, 9B:
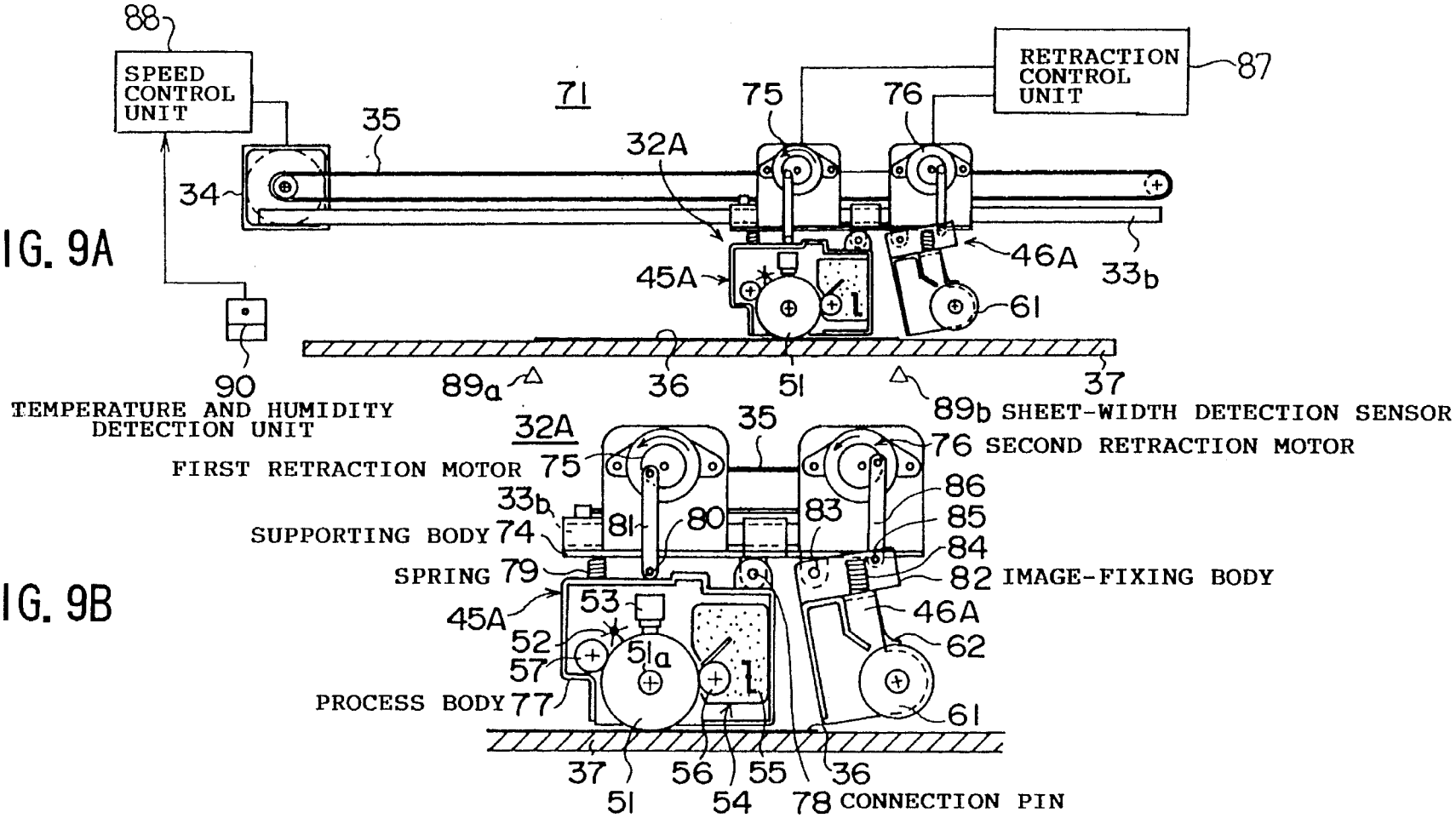
FIGS. 9A and 9B are, respectively, a cross-sectional view taken along a line A—A of FIG. 8 and an enlarged partial view of FIG. 9A.

FIGS. 9A and 9B show a cross-sectional view taken along a line A—A of FIG. 8 and a enlarged partial view thereof, respectively.

In FIGS. 9A and 9B, the carriage $32_A$ is provided with a first retraction motor 75 and a second retraction motor 76 mounted on a supporting body 74. The supporting body 74 is hooked to the guiding shafts 33*a* and 33*b*. The first retraction motor 75 is used for retracting the process unit $45_A$, and the second retraction motor 76 is used for retracting the image-fixing unit $46_A$. A process body 77 is connected at one end of a top surface thereof with a lower surface of the supporting body 74 by means of a connection pin 78. A spring 79 connects the other end of the top surface of the process body 77 with the supporting body 74.

The process body 77 is connected at a middle point of the top surface thereof with one end of an arm 81 by means of a connection pin 80. The other end of the arm 81 is connected to an eccentric point of the first retraction motor 75. Thus, a rotation of the first retraction motor 75 moves the arm 81 up and down. Along with this movement, the process body 77 is pivoted about the connection pin 78 so as to be separated from the recording sheet 36.

Inside the process body 77, the electrification unit 52, the light-exposure unit 53, the developing unit 54, and the cleaner 57 are arranged around the recording drum 51 in the same manner as in FIG. 5A. These components make up the process unit $45_A$.

An image-fixing body 82 arranged beside the process body 77 is connected at an end thereof with the lower surface of the supporting body 74 by means of a connection pin 83, and is also connected with the same lower surface via a spring 84. At the other end, the image-fixing body 82 is connected with an arm 86 by means of a connection pin 85. The other end of the arm 86 is connected to an eccentric point of the second retraction motor 76.

Thus, a rotation of the second retraction motor 76 moves the arm 86 up and down. Along with this movement, the image-fixing body 82 is pivoted about the connection pin 85 so as to be separated from the recording sheet 36.

Inside the image-fixing body 82, the image-fixing roller 61 and the thermistor 62 are provided in the same manner as in FIG. 5A. The image-fixing roller 61 has a halogen lamp within it as a heat source.

The first and second retraction motors 75 and 76 are controlled by a retraction control unit 87, which serves as retraction control means. The carrier motor 34 is controlled by a speed control unit 88, which serves as speed control means.

Sheet-width detection sensors 89*a* and 89*b* are provided around the image-transfer unit 37, and detect a width of the recording sheet 36. A temperature and humidity detection sensor 90 is provided at an appropriate position (near the home-position in this example). Detected temperature and humidity are sent to the speed control unit 88.

FIGS. 10A and 10B and FIGS. 11A and 11B show an operation of the second embodiment.

Figure 10A:
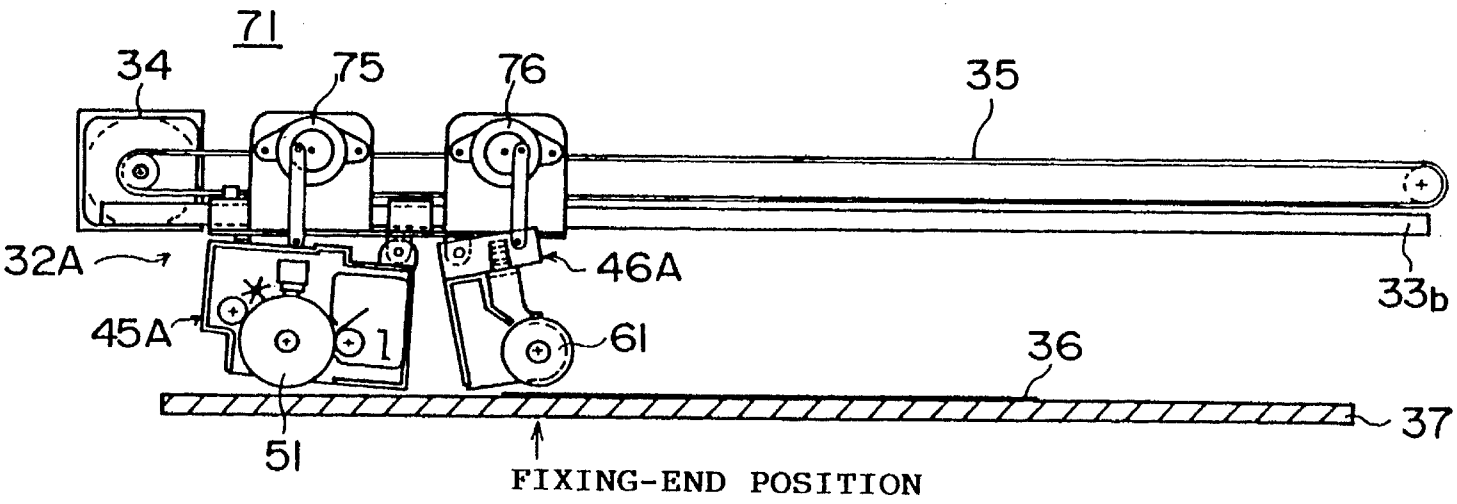
FIGS. 10A and 10B are illustrative drawings for explaining an operation of the serial-type electronic photographic printer of FIG. 8.

FIG. 10A shows a state in which the carriage $32_A$ is in an idle state at the home position. In this state, the first and second retraction motors 75 and 76 are rotated such that the process unit $45_A$ and the image-fixing unit $46_A$, respectively, are swung and separated from the recording sheet 36 (or the image-transfer unit 37).

Figure 10B:
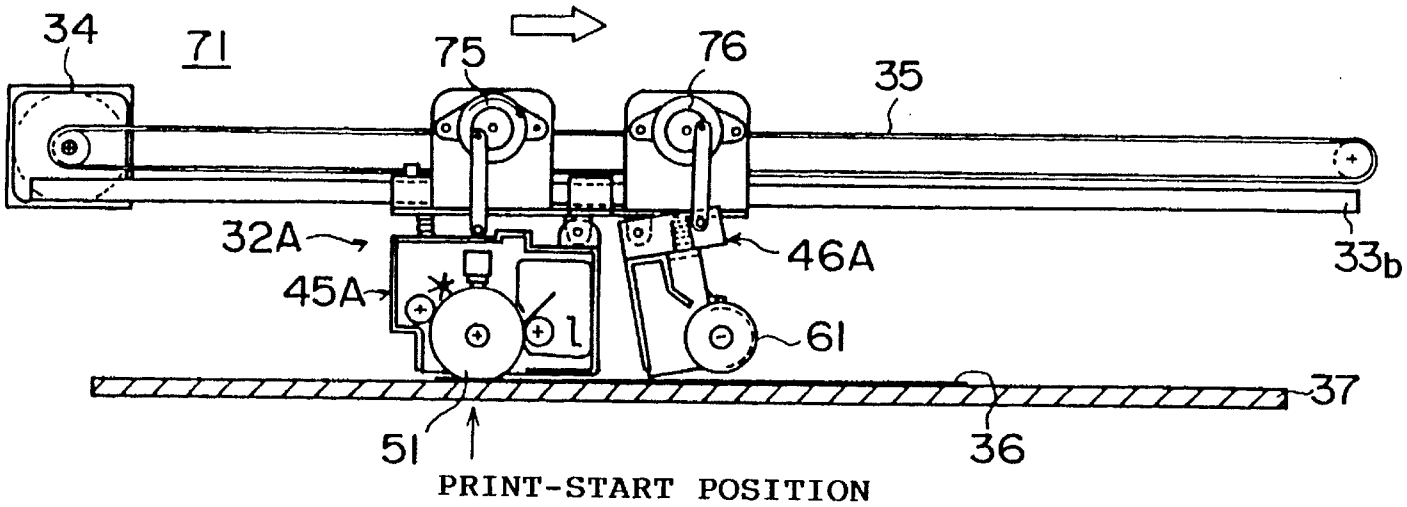

FIG. 10B shows a state in which the carrier motor 34 has moved the carriage $32_A$ until the recording drum 51 of the process unit $45_A$ is positioned at a print-start position on the recording sheet 36. This movement is activated when the sheet-width detection sensor 89*a* and 89*b* detect the presence of the recording sheet 36. At this position, the first retraction motor 75 is rotated such that the process unit $45_A$ is released from the retracting position. Thus, the recording drum 51 comes in touch with the recording sheet 36 at the print-start position.

Then, the carrier motor 34 drives the carriage $32_A$ so that the process unit $45_A$ prints an image on the recording sheet. At the same time, the temperature and humidity sensor 90 detects humidity of the environment so as to set a speed of the carriage $32_A$ to an optimum speed. The control of the speed of the recording drum 51 of the process unit $45_A$ makes it possible to obtain a high-quality image at the optimum speed.

Figures 11A, 11B:
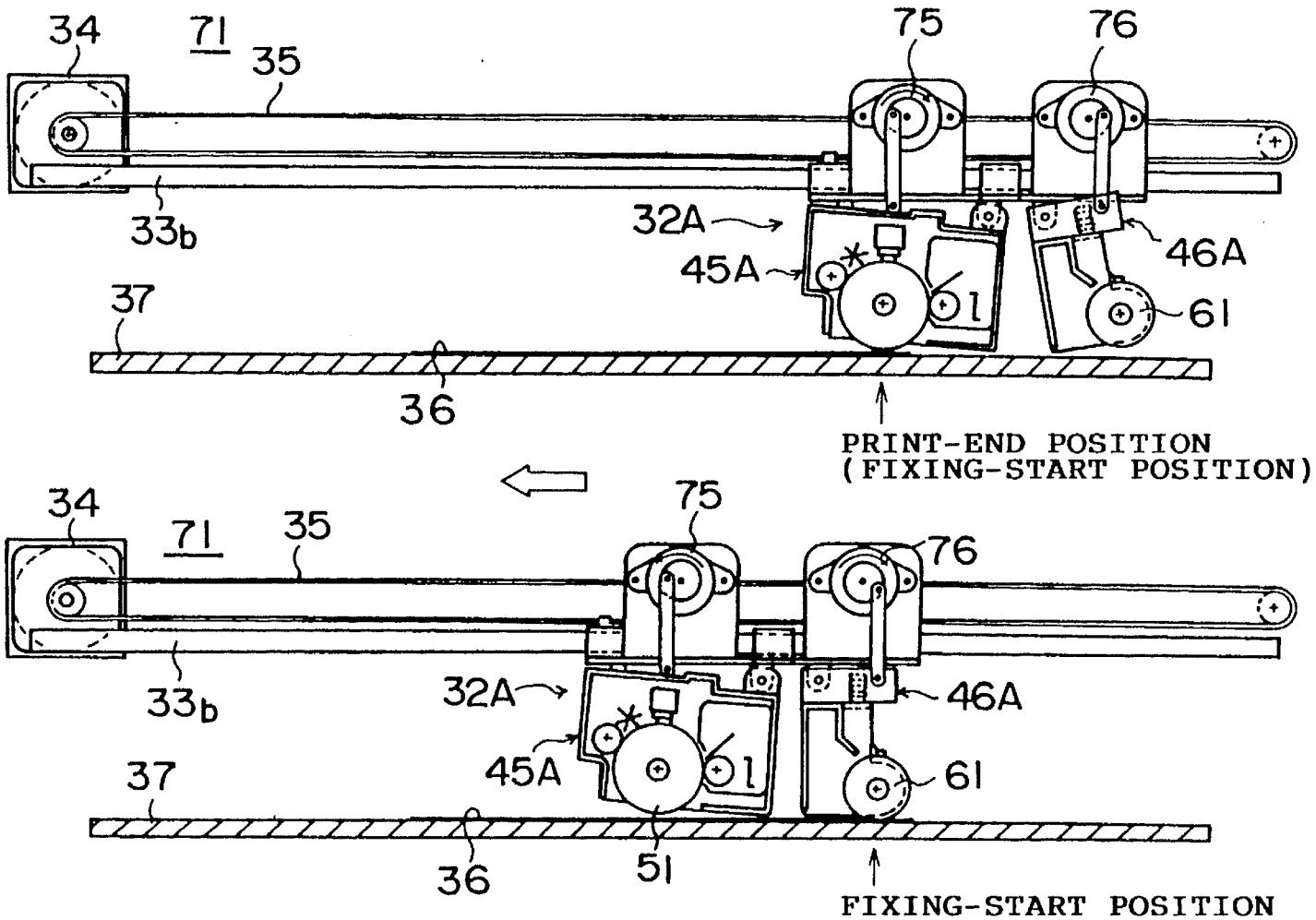
FIGS. 11A and 11B are illustrative drawings for explaining an operation of the serial-type electronic photographic printer of FIG. 8.

FIG. 11A shows a state in which the carriage $32_A$ is stopped at a print-end position on the recording sheet 36. In this state, the first retraction motor 75 is rotated such that the process unit $45_A$ is retracted.

FIG. 11B shows a state in which the carrier motor 34 drives the carriage $32_A$ until the image-fixing roller 61 is positioned at a fixing-start position (print-end position) on the recording sheet 36. In this state, the second retraction motor 76 is rotated such that the image-fixing unit $46_A$ is released from the retracting position. Thus, the image-fixing roller 61 comes in contact with the recording sheet 36 at the fixing-start position.

Then, the carrier motor 34 drives the carriage $32_A$ toward the home position, with the image-fixing unit $46_A$ fixing an image on the recording sheet 36. The temperature and humidity sensor 90 detect temperature of the environment. Based on the detected temperature, the speed control unit 88 sets an optimum speed for the movement of the image-fixing unit $46_A$. For example, the speed of the movement of the carriage $32_A$ is set to a low speed when the temperature is low, while the speed is set to a high speed when the temperature is high.

The control of the speed of the image-fixing roller 61 according to the temperature of the environment realizes an improved fixing of the image. This results in a high-quality image.

In the second embodiment described above, the printing operation by the recording drum 51 and the fixing operation by the image-fixing roller 51 are carried out separately at different timings. Thus, the lifting of the recording sheet 36 during the printing operation can be avoided. Also, friction between the recording drum 51 and the recording sheet 36 can be prevented, so that a high-quality image can be obtained without the coloring of the background.

Also, the separate printing operation and image-fixing operation enable setting the respective optimum speeds for these two operations in accordance with the temperature and humidity of the environment. Thus, a high-quality image can be obtained.

As described above, according to the first embodiment of the present invention, the clampers as the recording-sheet fixing means are swung to hold the recording sheet only during the operations of the process means and the image-fixing means. Thus, the lifting of the recording sheet can be avoided during these operations, which results in the improved printing quality.

According to the second embodiment of the present invention, the first and second retraction motors can retract the process means and the image-fixing means, respectively. Thus, the image-fixing means does not affect the operation of the printing means, so that the lifting of the recording sheet can be avoided. This results in an improved printing quality. Also, since the speeds of the movement of the process means and the image-fixing means can be controlled separately, the optimum speeds can be separately set for the process means and the image-fixing means. Thus, a printing quality can be improved. Here, the optimum speeds can be determined based on the temperature and the humidity detected by the sensor. Thus, the printing operation and the image-fixing operation can be conducted at the respective optimum speeds regardless of variations in the temperature and the humidity. This results in an improved printing quality.

Further, the present invention is not limited to these embodiments, but various variations and modifications may be made without departing from the scope of the present invention.

What is claimed is:

1. An image forming device comprising:

conveying means for conveying a recording sheet in a first direction;

processing means for forming a latent image of static charge and developing said latent image into an image on an image-holding body, which rolls on said recording sheet in a second direction perpendicular to said first direction so as to transfer said image on to said recording sheet;

image-transfer means for aiding said image-holding body for transferring said image on to said recording sheet, said image-holding body rolling on a first surface of said recording sheet and said image-transfer means provided beneath a second surface of said recording sheet;

image-fixing means for fixing said image on said recording sheet;

a carriage carrying said process means and said image-fixing means, which carriage moves in said second direction;

recording-sheet fixing means for holding said recording sheet by touching said first surface when said process means and said image-fixing means operate as said carriage moves, said recording-sheet fixing means extending along said second direction on both sides of said carriage;

wherein said recording-sheet fixing means comprises at least one clamper capable of swinging so as to hold and release said recording sheet and clamper driving means for swinging said at least one clamper.

2. An image forming device comprising:

conveying means for conveying a recording sheet in a first direction;

process means for forming a latent image of static charge and developing said latent image into an image on an image-holding body, which rolls on said recording sheet in a second direction perpendicular to said first direction so as to transfer said image on to said recording sheet;

image-fixing means for fixing said image on said recording sheet by touching said recording sheet;

a carriage carrying said process means and said image-fixing means, which carriage moves in said second direction;

a first retraction means for separating said process means from said recording sheet when said image-fixing means is operating; and a second retraction means for separating said image-fixing means from said recording sheet when said process means is operating.

3. The image forming device as claimed in claim 2, further comprising:

movement means for driving said carriage in said second direction; and speed control means for controlling said movement means so that a speed of said carriage during operations of said process means and said image-fixing means can be controlled.

4. The image forming device as claimed in claim 3, further comprising means for detecting a temperature of an operation environment, wherein said speed control means controls said movement means based on said temperature.

5. The image forming device as claimed in claim 4, further comprising means for detecting a humidity of said operation environment, wherein said speed control means controls said movement means based on said humidity.

6. The image forming device as claimed in claim 4, further comprising means for detecting a humidity of an operation environment, wherein said speed control means controls said movement means based on said humidity.

7. An image forming device comprising:

conveying means for conveying a recording sheet in a first direction;

process means for forming a latent image of static charge and developing said latent image into an image on an image-holding body, which rolls on said recording sheet in a second direction perpendicular to said first direction so as to transfer said image on to said recording sheet;

image-fixing means for fixing said image on said recording sheet;

a carriage carrying said process means and said image-fixing means, which carriage moves in said second direction;

recording-sheet fixing means for holding said recording sheet when said process means and said image-fixing means operate as said carriage moves;

a first retraction means for separating said process means from said recording sheet when said image-fixing means is operating; and a second retraction means for separating said image-fixing means from said recording sheet when said process means is operating.

8. The image forming device as claimed in claim 7, further comprising:

movement means for driving said carriage in said second direction; and speed control means for controlling said movement means so that a speed of said carriage during operations of said process means and said image-fixing means can be controlled.

9. The image forming device as claimed in claim 8, further comprising means for detecting a temperature of an operation environment, wherein said speed control means controls said movement means based on said temperature.

10. The image forming device as claimed in claim 9, further comprising means for detecting a humidity of said operation environment, wherein said speed control means controls said movement means based on said humidity.

11. The image forming device as claimed in claim 9, further comprising means for detecting a humidity of an operation environment, wherein said speed control means controls said movement means based on said humidity.

* * * * *